United States Patent [19]

Debenham et al.

[11] 4,267,938

[45] May 19, 1981

[54] RESEALABLE PRESSURE RELEASE CLOSURES

[75] Inventors: Michael Debenham, Frankston; Allan G. Dalli, Warrandyte; Peter L. Revill, Middle Park, all of Australia

[73] Assignee: The Broken Hill Proprietary Company Limited, Melbourne, Australia

[21] Appl. No.: 81,361

[22] Filed: Oct. 3, 1979

[30] Foreign Application Priority Data

Oct. 10, 1978 [AU] Australia ..... PD6325

[51] Int. Cl.[3] ..... B65D 17/32

[52] U.S. Cl. ..... 220/268; 220/271

[58] Field of Search ..... 220/266–273

[56] References Cited

U.S. PATENT DOCUMENTS

| | | | |
|---|---|---|---|
| 3,741,432 | 6/1973 | Werth et al. | 220/268 |
| 3,931,909 | 1/1976 | Dalli et al. | 220/268 |
| 4,054,228 | 10/1977 | Balocca et al. | 220/268 |

*Primary Examiner*—George T. Hall

*Attorney, Agent, or Firm*—Murray and Whisenhunt

[57] ABSTRACT

This specification discloses certain improvements in resealable pressure releasing closures of the type disclosed in U.S. Pat. Nos. 4,105,134 and 4,155,480 Debenham et al. In the several improvements disclosed in the specification, the resealing properties of the closure are improved by reducing the concentration of the flexure of the closure at the connection between the closure and the can end to thereby reduce the extent to which the material defining the connection permanently deforms during the opening operation. In one embodiment the pressure releasing closure or tab 20 has a connection 23 to the can end which is at substantially the same level as the adjacent portion of the closure by the provision of an area 26 immediately behind the connection which is downwardly depressed so as to be co-planar with the tab 20. In another embodiment the upwardly raised bead 31 extends from the connection 32 into the closure 30 to substantially stiffen the connection 32 and discourage bending of the sheet metal at the connection 32. Other embodiments involve the cold reduction of the pressure releasing closure and the shape of the closure to make the bending thereof more uniform during the opening operation.

14 Claims, 7 Drawing Figures

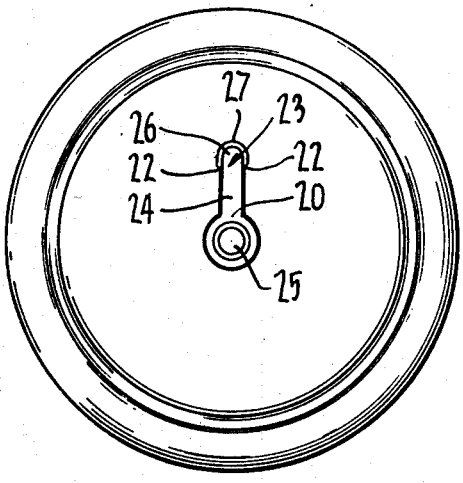
FIG. 1.
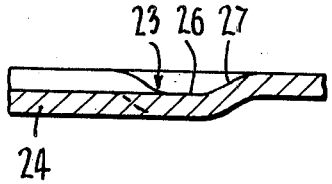
FIG. 2.
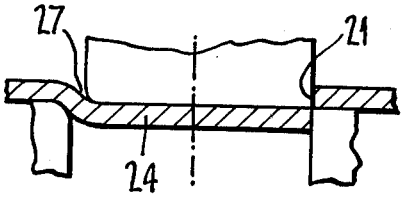
FIG. 3.
FIG. 4.
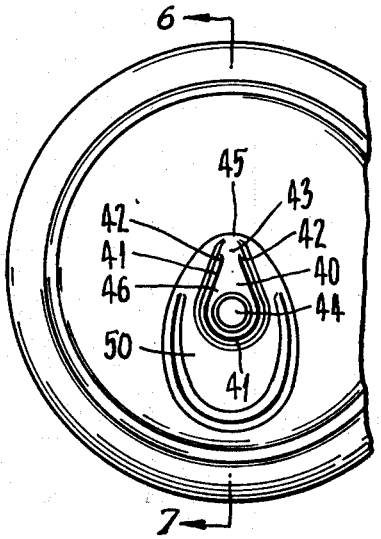
FIG. 6.
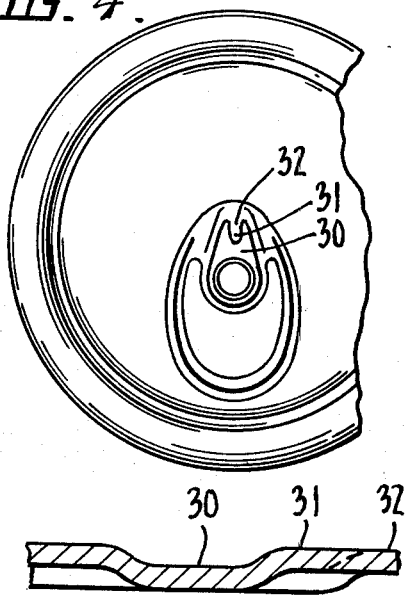
FIG. 5.
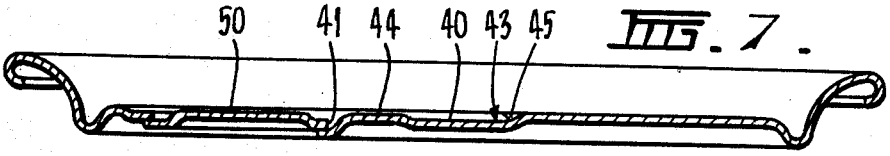
FIG. 7.

RESEALABLE PRESSURE RELEASE CLOSURES

BACKGROUND OF THE INVENTION

This invention relates to improvements in push-in easy opening closures and more particularly to resealable pressure releasing closures of the type suitable for can ends containing carbonated beverages.

Australian Patent Application No. 35318/78 (incorporating provisional specifications PD 0416, PD 0848 and PD 1840), U.S. Pat. Nos. 4,105,134 and 4,155,480 Debenham et al, the disclosures of which specifications are incorporated into this specification by cross reference, describe various forms of resealable pressure releasing closures designed to improve the opening characteristics of can ends for highly carbonated beverages. The closures operate on the principle that by enabling the pressure releasing closure to reseal in the absence of a digitally applied push-in force, the pressure within the can may be released gradually, for example, in short bursts, in the event that the contents of the can tend to gush or spurt. The closures described in the above specifications are constructed in combination with the surrounding portions of the can end to prevent deflection of the closure by an amount at which the yield point of the metal at the connection between the closure and the can end will be exceeded, whereby the tab springs back to at least a substantially closed position when the push-in force is released.

It has been found that by making certain design changes to the resealable pressure releasing closures disclosed in the above applications, and particularly those of the general type shown in FIGS. 17 and 18 of Application No. 35318/78 and FIGS. 5 and 6 of U.S. Pat. No. 4,155,480, substantial improvements in the resealing properties of the closures may be achieved while retaining design features which maintain the commercial attractiveness of the closures.

SUMMARY OF THE INVENTION

It is the object of the present invention to provide improvements in push-in easy opening closures which improve the resealing or "springback" properties of such closures.

In the case of several of the designs described in the above applications, the pressure releasing closure is substantially rigid along its length and as such the flexing of the closure resulting from a digitally applied force occurs principally at the connection between the closure and the can end. The purpose of each improvement of the present invention is to provide means whereby the flexure of the closure resulting from the push-in force is less concentrated at the connection between the closure and the can end whereby the resealing properties of the closure are improved.

In its broadest form, the invention provides, a push-in easy opening closure comprising an aperture in a container member, a push-in pressure releasing resealable closure integral with said container member through a connection to said container member and overlapping with and underlying said container member to close said aperture, characterised in that said closure is formed, at least in the region of said closure adjacent said connection, in such a manner that during the opening of said closure the flexure of said closure along said region is rendered more uniform and less concentrated at said connection, whereby the resealing properties of the closure are improved. In other words, the formation of the closure, at least in the region of said connection, reduces the extent to which the material defining the connection permanently deforms during the opening operation.

In a first improvement, said closure is shaped, at least in the region of said closure adjacent said connection, so that said closure flexes generally uniformly along said region.

In the perfect case, the closure should flex substantially uniformly along its whole length whereby the stresses occurring when the push-in force is applied to the closure are uniformly distributed along the closure and the closure is equivalent to a uniformly stressed beam. However, this requires the closure to have a generally parabolic shape extending from said connection and this results in a closure having inadequate width at the end to which the push-in force is to be applied. Thus in order to make a practical closure, the shape must be modified to allow for the formation of the usual raised button on the closure. Nevertheless, it is still possible to alleviate the problems referred to above by increasing the width of the connection relative to the adjacent parts of the closure whereby approximately uniform flexing occurs for some distance from the connection. The connection is then no longer the weakest point of the closure and the closure will tend to have sufficient springback to reseal once it has been opened.

It has been determined that the yield strength of most sheet metals suitable for can ends can be increased by cold reduction of the sheet metal. As a result of the increase in yield strength, the springback properties of the material may be substantially improved.

Thus, in order to increase the improvement achieved in the manner defined above, or in fact in relation to any one of the improvements described herein, the sheet metal from which the container member is made may be cold reduced either locally or generally and either before, during or after the formation of the closure itself. One practical method of achieving the desired cold reduction is by forming the closure with a shaped coined area which increases the yield strength of the material of the closure in the required regions necessary to provide more uniform flexing of the closure. For example, by forming a coined area having a shape approximating the parabolic shape referred to above, it may be possible to form the closure in any desired shape and to adjust the yield strength of the metal in selected regions so as to achieve substantially uniform flexure of the closure at least substantially along the length of the closure.

In all of the closure designs described in the above patents and applications, the pressure releasing closure is preferably severed from the parent metal and the end worked to make the closure overlap and underly the remainder of the end. Since the closure underlies the end, this necessarily results in a step in the metal at the connection between the closure and the end (see for example reference 83 in FIG. 18 of Application No. 35318/78 and FIG. 6 of U.S. Pat. No. 4,155,480). It has been found that this disturbance of the sheet metal at the connection further encourages the closure to bend at the connection rather than to flex as is required to achieve the necessary resealing properties.

In a second improvement, the invention provides a push-in easy opening closure comprising an aperture in a container member, a push-in pressure releasing resealable closure integral with said container member through a connection to said container member and overlapping with and underlying said container member to close said aperture, the said connection to said container member being formed in a portion of the container member which is at substantially the same level as the adjacent portion of said closure.

The above effect may be achieved by downwardly depressing the area of the container member immediately behind said connection so that the metal across the connection is substantially flat. This has been found to substantially improve the springback properties of the closure since it reduces the tendency for the closure to develop a permanent set at the connection in the presence of a digitally applied push-in force.

In a third improvement, a pressure releasing closure having any one of the configurations described in the above application or patents, or in accordance with any one of the preceding or following improvements, is subjected to coining in the area in which the connection between the closure and the container member is formed. The coining may take place either before, during or after the formation of the closure, although where the closure connection is stepped as described above, it is not practical to coin the connection following formation thereof.

In a preferred form the sheet metal is coined to such an extent that it is reduced in thickness by 25% to 30%. For example, sheet plate of 0.30 mm thickness may be locally reduced in thickness to about 0.20 to 0.23 mm. Suitable results may be achieved by coining to achieve the above thickness reduction in an area about 5 mm in diameter centred on the mid-point of a line connecting the ends of the lines of severance.

In a fourth improvement, a pressure releasing closure having any one of the configurations as described in the above applications, or in accordance with any one of the preceding or following improvements, is formed with a rib or spine extending partly along its length at least from the connection of the closure to the container member. The formation of a spine or rib increases the section modulus of the closure in this region and creates a resistance against bending of the metal at or near the connection.

BRIEF DESCRIPTION OF THE DRAWINGS

Several embodiments of the improvements defined above will now be described with reference to the accompanying drawings in which:

FIG. 1 is a fragmentary plan view of a can end incorporating a modified pressure releasing closure according to the invention;

FIG. 2 is an enlarged fragmentary sectional elevation of the closure of FIG. 1 taken along the length of the closure in the region of its connection to the end;

FIG. 3 is a schematic representation of the manner in which the punch/die set for forming the closure of FIGS. 1 and 2 is modified to achieve the improved closure;

FIG. 4 is a fragmentary plan view of a can end incorporating a further modified pressure releasing closure embodying the invention;

FIG. 5 is a fragmentary sectional elevation, similar to FIG. 2, showing the closure of FIG. 4;

FIG. 6 is a plan view of a can end incorporating a modified pressure releasing closure and dispensing closure combination, and FIG. 7 is a sectional elevation taken along the line 6–7 in FIG. 6.

Referring firstly to FIGS. 1 to 4, one embodiment of the second improvement defined above is shown in more detail. In this embodiment, a pressure releasing closure or tab 20 is defined by a line of serverance 21 which terminates at 22 to define a connection 23 therebetween. The tab 20 has a shank portion 24 and an enlarged head which is formed into a raised button 25 for the application of a digitally applied push-in force. The area 26 immediately behind the connection 23 is downwardly depressed so as to be co-planar with the tab 20. A downwardly sloping shoulder 27 is formed between the area 26 and the remainder of the can end. In the embodiment shown, the area 26 extends behind the connection 23 for approximately 3 mm. However, the length of the area 26 is not critical and it is believed that a length of approximately 1 mm should suffice.

FIG. 3 of the drawings is a schematic representation of the manner in which the punch/die set is modified to achieve the above result. The right side of the Figure represents the punch/die configuration which achieves the line of severance, while the left side of the Figure shows the punch and/or die having been relieved in the region immediately following the end of the line of severance to depress the metal in this region to leave the connection 23 undisturbed.

An embodiment of the fourth improvement defined above is shown in FIGS. 4 and 5 of the drawings in which a pressure releasing closure or tab 30 of the type described in connection with FIG. 17 of Application No. 35318/78 or FIG. 6 of U.S. Pat. No. 4,155,480 is formed with an upwardly raised bead 31 extending from the connection 32 and at the same level as the sheet metal of the end extending away from the connection 32. The formation of the bead 31 substantially stiffens the connection 32 and discourages bending of the sheet metal at the connection 32 for most digitally applied push-in forces experienced in use.

In the embodiment shown in FIGS. 6 and 7 of the drawings, the can end is formed with a pressure releasing closure 40 and a pouring or dispensing closure 50 of the type described in the preceding paragraph. However, the pressure releasing closure or tab 40 incorporates the second and third improvements described above.

The tab 40 is defined by a line of severance 41 which terminates at 42 to define a connection 43. The tab 40 is formed with a raised button 44 by means of which a digitally applied push-in force may be applied to the tab 40. It will be noted that the line of severance 41 between the connection 43 and the button 44 is straight to ensure structural integrity of the can end in this region under the conditions encountered in use. A region 45 of the end immediately behind the connection 43 is downwardly depressed in a manner similar to that shown in FIG. 2 so that the sheet metal behind the connection 43 is co-planar with the sheet metal in the shank of the tab 40. In addition, the tab 40 is coined, at least in the region 46 between the button 44 and the region 45 to increase the yield strength of the metal in this region and thereby improve the springback properties of the tab 40. The region of the tab 40 surrounding the button 44 is also coined when the region 46 is coined to provide overlap between the tab 40 and the sheet metal surrounding the aperture defined by the line of severance 41. By forming the pressure releasing tab 40 in the above manner, improved resealing properties are achieved for all sheet metals suitable for the manufacture of easy-opening can ends and a closure of greater commercial acceptability results.

The line of severance 41 may be smoothly waisted between the connection 43 and the button 44 to partially increase the ability of the tab 40 to uniformly flex along its length. Although this arrangement is less attractive commercially by virtue of the small reduction in structural integrity of the closure, it may be possible to overcome this problem and therefore obtain the increased uniformity of flexure offered by this partial adoption of the first improvement described above.

In addition to improving the springback properties of the metal at the connection, the various improvements described above also result in a reduction of any tendency for the closure to fracture at the connection, for example on being deflected when the pouring closure 50 is opened.

It will be appreciated that any one or more of the improvements described above may be applied to a pressure releasing resealable closure to improve its resealing properties. In addition, the sealant which is applied to the closure to hermetically seal same may be selected so as to further assist in the resealability of the closure. For example, by selecting a sealant which tends to stretch before being ruptured, the sealant may remain intact along the sides of the pressure releasing closure to thereby assist in the resealing movement of the closure.

We claim:

1. In a push-in easy opening closure comprising an aperture in a container member and a push-in pressure releasing resealable closure overlapping with and underlying said container member to close said aperture, the improvement comprising connection means integrally connecting said closure to said container member for rendering flexure of said closure, during opening of said closure, more uniform and less concentrated, at least in the region of said closure adjacent said connection means, to improve the resealing properties of said closure.

2. The closure of claim 1, wherein said closure is shaped, at least in the region of said connection means, to approximate a generally parabolic configuration extending from said connection means towards the free end of said closure.

3. The closure of claim 2, wherein the closure is cold reduced at least in the region including said connection means and extending into said closure.

4. A push-in easy opening closure comprising an aperture in a container member, a push-in pressure releasing resealable closure integral with said container member through a connection to said container member and overlapping with and underlying said container member to close said aperture, characterised in that the said connection to said container member is formed in a portion of said container member which is at substantially the same level as the adjacent portion of said closure.

5. The closure of claim 4, wherein the area of the container member immediately behind said connection is downwardly depressed to be at substantially the same level as the material defining the closure at and adjacent said connection so that the metal across the connection is substantially flat.

6. The closure of claim 4 or 5, wherein the closure is cold reduced at least in the region including said connection and extending into said closure.

7. A push-in pressure releasing closure in a sheet metal container member, comprising a closure member formed integrally from a portion of the container member and defined by at least a weakening line and capable of being opened by a digitally applied push-in force, said closure member having a connection to said container member and an operating portion which is adapted in use to have said push-in force applied thereto, said closure member being substantially resealable in the absence of said push-in force, characterised in that said closure is subjected to cold reduction in the region including said connection to reduce the extent to which the material defining said connection permanently deforms during opening of said closure whereby the resealable properties of said closure are improved.

8. The closure of claim 7, wherein said cold reduction reduces the thickness of the sheet metal by from 25% to 30%.

9. The closure of claim 7 or 8, wherein said closure is cold reduced in a region extending across said connection and to a position adjacent said operating portion.

10. A push-in pressure releasing closure in a sheet metal container member, comprising a closure member formed integrally from a portion of the container member and defined by at least a weakening line and capable of being opened by a digitally applied push-in force, said closure member having a connection to said container member and an operating portion which is adapted in use to have said push-in force applied thereto, said closure member being substantially resealable in the absence of said push-in force, characterised by the formation of a raised bead extending at least partly into said closure from said connection thereby reducing the extent to which the material defining said connection permanently deforms during the opening of the closure.

11. The closure of claim 10, wherein the raised bead is at the same level as the sheet metal of the container member extending away from said connection.

12. The closure of claim 1, wherein the closure is coined in a region extending across said connection and to a position adjacent said operating portion.

13. The closure of claim 1, wherein said closure is coined in a region extending across said connection means.

14. The closure of claim 4, wherein said portion of said container member extends on said container member at least 1 mm. from said connection.

* * * * *